US009227161B2

(12) United States Patent
Bormes et al.

(10) Patent No.: US 9,227,161 B2
(45) Date of Patent: Jan. 5, 2016

(54) DEVICE FOR THE ENRICHMENT OF A LIQUID STREAM WITH A GAS

(75) Inventors: Sascha Bormes, Kenn (DE); Karl Bermes, Irrel (DE); Hartmut Britzen, Irrel (DE)

(73) Assignee: LUXEMBOURG PATENT COMPANY S.A., Luxembourg (LU)

( * ) Notice: Subject to any disclaimer, the term of this patent is extended or adjusted under 35 U.S.C. 154(b) by 1582 days.

(21) Appl. No.: 12/673,234

(22) PCT Filed: Aug. 12, 2008 (Under 37 CFR 1.47)

(86) PCT No.: PCT/EP2008/060602

§ 371 (c)(1), (2), (4) Date: Apr. 4, 2011

(87) PCT Pub. No.: WO2009/021960

PCT Pub. Date: Feb. 19, 2009

(65) Prior Publication Data

US 2012/0038068 A1 Feb. 16, 2012

(30) Foreign Application Priority Data

Aug. 14, 2007 (LU) ..... 91355
Apr. 23, 2008 (LU) ..... 91432

(51) Int. Cl.
*B01F 3/04* (2006.01)
*B01F 5/04* (2006.01)
*B01F 15/00* (2006.01)

(52) U.S. Cl.
CPC ..... *B01F 3/04787* (2013.01); *B01F 3/04985* (2013.01); *B01F 5/0413* (2013.01); *B01F 15/00162* (2013.01); *B01F 15/00344* (2013.01);

(Continued)

(58) Field of Classification Search
CPC ..... B01F 3/04787; B01F 3/04985; B01F 5/0413; B01F 15/00344; B01F 15/00162; B01F 15/00123; B01F 2215/0022; B01F 2003/04893; B01F 2003/049
USPC ..... 261/64.3, 76, 79.2, DIG. 75; 366/163.2
See application file for complete search history.

(56) References Cited

U.S. PATENT DOCUMENTS 4,123,800 A 10/1978 Mazzei
4,173,178 A 11/1979 Wienland (Continued)

FOREIGN PATENT DOCUMENTS

WO 2004024306 A1 3/2004

OTHER PUBLICATIONS

International Search Report PCT/EP2008/060602; Dated Oct. 13, 2008.

*Primary Examiner* — Charles Bushey
(74) *Attorney, Agent, or Firm* — Cantor Colburn LLP

(57) ABSTRACT

A device for the enrichment of a liquid stream with a gas is provided including a flow mixer (14) with a venturi nozzle (36), having a rotationally symmetrical contraction (40) with a diameter D and being flown through axially by the liquid stream. The invention additionally includes a gas feed for the lateral feed of the gas into the contraction (40) of the venturi nozzle (36). The gas feed includes at least one gas channel (54, 54') with a diameter d<0.5D, ending laterally in the contraction (40) of the venturi nozzle (36) in a way, such that the elongated longitudinal axis (56, 56') thereof is tangential to an imaginary cylinder surface (58), which is coaxial to the contraction (40) and has a diameter D'>d.

17 Claims, 4 Drawing Sheets

(52) U.S. Cl.
CPC ..... *B01F 15/00123* (2013.01); *B01F 2003/049* (2013.01); *B01F 2003/04893* (2013.01); *B01F 2215/0022* (2013.01)

(56) References Cited

U.S. PATENT DOCUMENTS

| | | | | | |
|---|---|---|---|---|---|
| 4,761,077 | A * | 8/1988 | Werner | 366/165.1 |
| 5,004,484 | A * | 4/1991 | Stirling et al. | 95/263 |
| 5,520,856 | A * | 5/1996 | Garrett et al. | 261/76 |
| 5,674,312 | A | 10/1997 | Mazzei | |
| 5,842,600 | A | 12/1998 | Singleterry | |
| 6,060,092 | A | 5/2000 | Oesterwind | |
| 6,082,713 | A * | 7/2000 | King | 261/79.2 |
| 6,237,897 | B1 * | 5/2001 | Marina | 261/64.1 |
| 6,969,052 | B2 * | 11/2005 | Korzeniowski | 261/76 |
| 7,090,203 | B2 * | 8/2006 | Goto | 261/22 |
| 2002/0096792 | A1 | 7/2002 | Valela | |
| 2003/0015596 | A1 * | 1/2003 | Evans | 239/8 |
| 2004/0251566 | A1 * | 12/2004 | Kozyuk | 261/76 |
| 2005/0133615 | A1 | 6/2005 | Gopalan | |
| 2005/0275119 | A1 * | 12/2005 | Glomset | 261/76 |

* cited by examiner

DEVICE FOR THE ENRICHMENT OF A LIQUID STREAM WITH A GAS

TECHNICAL FIELD

The present invention generally relates to a device for enriching a liquid stream with gas. In particular, it relates to a device for enriching a drinking water stream with carbon dioxide.

BACKGROUND

Devices for enriching drinking water with carbon dioxide (also designated by carbonation of drinking water) have been known for a long time. In most of these devices, carbonation of the drinking water occurs in a storage container. Recently, however, devices have also been developed for enriching tap water in the home or restaurants with carbon dioxide in a continuous process. In the continuous process without any storage container, carbonation takes place in a flow-through mixer which is directly connected to the drinking water pipe. As compared with standard devices with a storage container, carbonation of tap water in the continuous process without any storage container has the advantage of being essentially more compact, economical and further also hygienic. In direct comparison with carbonation devices with a storage container, the quality of the carbonation of tap water in the continuous process without any storage container however still leaves a great deal to be desired. A problem is also i.a. that the pressure in the drinking water pipe may be between 2 bars and 6 bars, and that the flow-through mixer has to be adapted consequently to very different water pressures.

A device for enriching drinking water with carbon dioxide in the continuous process is for example described in WO 2004/024306. The flow-through mixer has a nozzle annular gap for water and a central gas injection. The pressure in the flow-through mixer is maintained constant by means of an overflow valve in the tapping pipe and an additional pressure stabilizer in the flow-through mixer itself. Further, a flow rate valve is positioned in the gas feed pipe, which should maintain constant the amount of gas fed into the flow-through mixer per unit of time. Further, the control comprises a solenoid valve in the water connection, and a solenoid valve in the gas connection of the flow-through mixer. Both solenoid valves are closed, in the case when a pressure monitor in the tapping type detects a pressure increase above the working pressure. Here, this is a relatively costly control technique, the fine adjustment of which is also relatively complicated. Further, the flow-through mixer only operates relatively perfectly for pressures above 3.5 bars.

An industrial device for enriching drinks with carbon dioxide is for example described in U.S. Pat. No. 5,842,600. In this industrial device, the gas is fed into a Venturi nozzle in a water stream. In this Venturi nozzle, the water flows out of a central nozzle, which is surrounded by an annular gap, from which the gas flows into the Venturi nozzle. Subsequently, water and gas are mixed in a static mixer tube. The water pressure is maintained constant by means of a pressure controller and a pump, so that carbonation always takes place under optimum conditions.

In EP 0322925, a Venturi arrangement is described for dispersing gas in a liquid stream. In a Venturi nozzle, the gas is fed with a type of injection needle before constriction axially in the Venturi nozzle. In order to optimize the result of the gas dispersion, the flow velocity of the gas bubbles/liquid mixture in the convergent section of the Venturi nozzle increases to a velocity lying above sound velocity, so that subsequently in the divergent section of the Venturi nozzle, it is again lowered to a velocity lying below the sound velocity. This of course means that a predetermined admission pressure of the liquid stream must be strictly observed.

A Venturi nozzle for carbonation of drinking water is known from EP 1579906. The latter has an inlet section converging in the direction of flow and an outlet section diverging in the direction of flow, which are connected through a constriction which is formed as a cylindrical channel. A gas channel opens into the constriction of the Venturi nozzle, the longitudinal axis of the gas channel being perpendicular to the longitudinal axis of the cylindrical constriction. Four longitudinal ribs are positioned in the divergent outlet section of the Venturi nozzle, which should prevent degassing of the water.

BRIEF SUMMARY

The invention creates a relatively simple device, which allows better enrichment of a liquid stream with a gas.

The invention further creates a relatively simple device which allows perfect and regular enrichment of the liquid stream with a gas in a relatively large pressure range, without costly presetting devices being required for this purpose.

The invention also creates an improved tapping device for carbonated tap water.

A device according to the invention for enriching a liquid stream with gas, comprises in a generally known manner, a flow-through mixer with a Venturi nozzle, which has the rotationally symmetric constriction with a diameter D and through which flows a liquid stream axially, as well as a gas feed for laterally feeding the gas into the constriction of the Venturi nozzle. According to the invention, this gas feed comprises at least one gas channel, with a diameter $d<0.5\ D$, preferably: $0.25\ d<d<0.5\ D$, which opens into the constriction of the Venturi nozzle laterally so that its extended longitudinal axis is tangential to an imaginary cylinder surface, which is coaxial with the constriction and has a diameter $D'>d$, preferably $D'=D-d$. With such a tangential gas feed into the constriction of the Venturi, a perfect and very regular enrichment of the liquid stream with gas was attained in tests. As a very significant advantage of the device according to the invention, it was also found that the flow-through mixer with its Venturi nozzle can be mounted both horizontally and vertically.

The constriction of the Venturi nozzle is advantageously formed by a cylindrical channel with a diameter D, its length preferably corresponding approximately to its diameter D.

The Venturi nozzle further advantageously has an inlet section converting in the direction of flow and an outlet section diverging in the direction of flow, which are connected through the constriction. The converging inlet section preferably has an opening angle, which is essentially more acute than the opening angle of the diverging outlet section. Preferably, the opening angle of the inlet section is approximately 2.5 to 3 times smaller than the opening angle of the outlet section.

In a preferred embodiment, a vortex device is positioned directly in front of the converging inlet section of the Venturi nozzle. This vortex device has the purpose of vortexing and channeling the water in front of the Venturi nozzle, which has a very positive influence on the carbonation result.

A particularly simple vortexing device comprises a body with an inlet cone converging in the direction of flow. In the body the inlet cone opens into an axial bore and an oblique bore. Other forms of the vortexing device are however not excluded.

The diverging outlet section of the Venturi nozzle advantageously opens into a cylindrical expansion chamber, the length of which corresponds to 1.5 to 2.5 times its diameter. This diameter of the expansion chamber is preferably about 8 to 12 times larger than the diameter D of the constriction. The expansion chamber is advantageously delimited axially by a baffle plate with through-holes.

In tests, it was noticed that for a relatively low admission pressure of the liquid stream, perfect enrichment is at best obtained with two or several gas channels. If the admission pressure of the liquid stream is relatively low, the gas feed should consequently comprise n gas channels (n>1) each with a diameter d<0.5 D, each of these gas channels opening into the constriction of the Venturi nozzle laterally so that its extended longitudinal axis is tangential to an imaginary cylinder surface, which is coaxial with the constriction, and has a diameter D'>d. All these n gas channels should feed in the gas preferably in the same direction, i.e. either clockwise or counter-clockwise into the constriction. Additionally, the extended longitudinal axes of the n gas channels (n>1) should preferably have tangency points (i.e. contacts points with the imaginary cylinder surface) angularly separated by 360°/n. For two gas channels, the tangency points lie separated by consequently 360°/2=180°, for three gas channels, 360°/3=120° and for four gas channels, 360°/4=90°. The openings of the gas channels into the constriction may also be here offset in the axial direction of the constriction.

The gas feed preferably comprises a gas pressure control valve for controlling the gas pressure as a function of the pressure in the liquid stream.

In a preferred embodiment, the gas feed comprises two gas channels, which open into the constriction, and a valve control which depending on the pressure in the liquid stream applies gas to either one or two gas channels. Such a valve control is advantageously formed so that up to a predetermined pressure $P_0$ in the liquid stream, gas is applied to two gas channels, starting from this pressure $P_0$, the gas is however only applied to one gas channel. In tests, it was namely noticed that for a relatively low admission pressure of the liquid stream, perfect enrichment is at best obtained with two gas channels; starting from a determined admission pressure of the liquid stream, perfect enrichment is at best obtained however with only one channel.

Although this valve control obtains particularly good results in the interaction with the tangential feed of the gas, described earlier, into the constriction of the Venturi nozzle, it is also possible to obtain with such a valve control, a result of the gas enrichment, which is less dependent on pressure than with other Venturi nozzles, which do not have the features of the gas feed described earlier. The present invention consequently also relates to a device for enriching a liquid stream with a gas, comprising a flow-through mixer with a Venturi nozzle through which flows the liquid stream, and a gas feed for feeding the gas via several lateral gas openings of the Venturi nozzle into the liquid stream, wherein this gas feed comprises a valve control, which starting from a determined pressure in the liquid stream, reduces the number of gas openings through which the gas flows into the Venturi nozzle; Here, provision is advantageously made for a gas pressure control valve in the gas feed in order to control the gas pressure as a function of the pressure in the liquid stream. The valve control advantageously comprises at least one solenoid valve and a pressure switch which controls the solenoid valve.

The present invention further relates to a tapping device for carbonated tapped water, comprising one of the predefined devices, wherein the pipe conveying the liquid stream is a drinking water pipe, which is connected to an inlet connection of the flow-through mixer, a tap unit is connected to an outlet connection of the flow-through mixer, and the gas feed comprises a carbon dioxide cylinder.

BRIEF DESCRIPTION OF THE FIGURES

Further features and advantages of the invention may be taken from the following detailed description of a preferred embodiment of the invention, which is made with reference to the appended figures.

DETAILED DESCRIPTION

Figure 1:
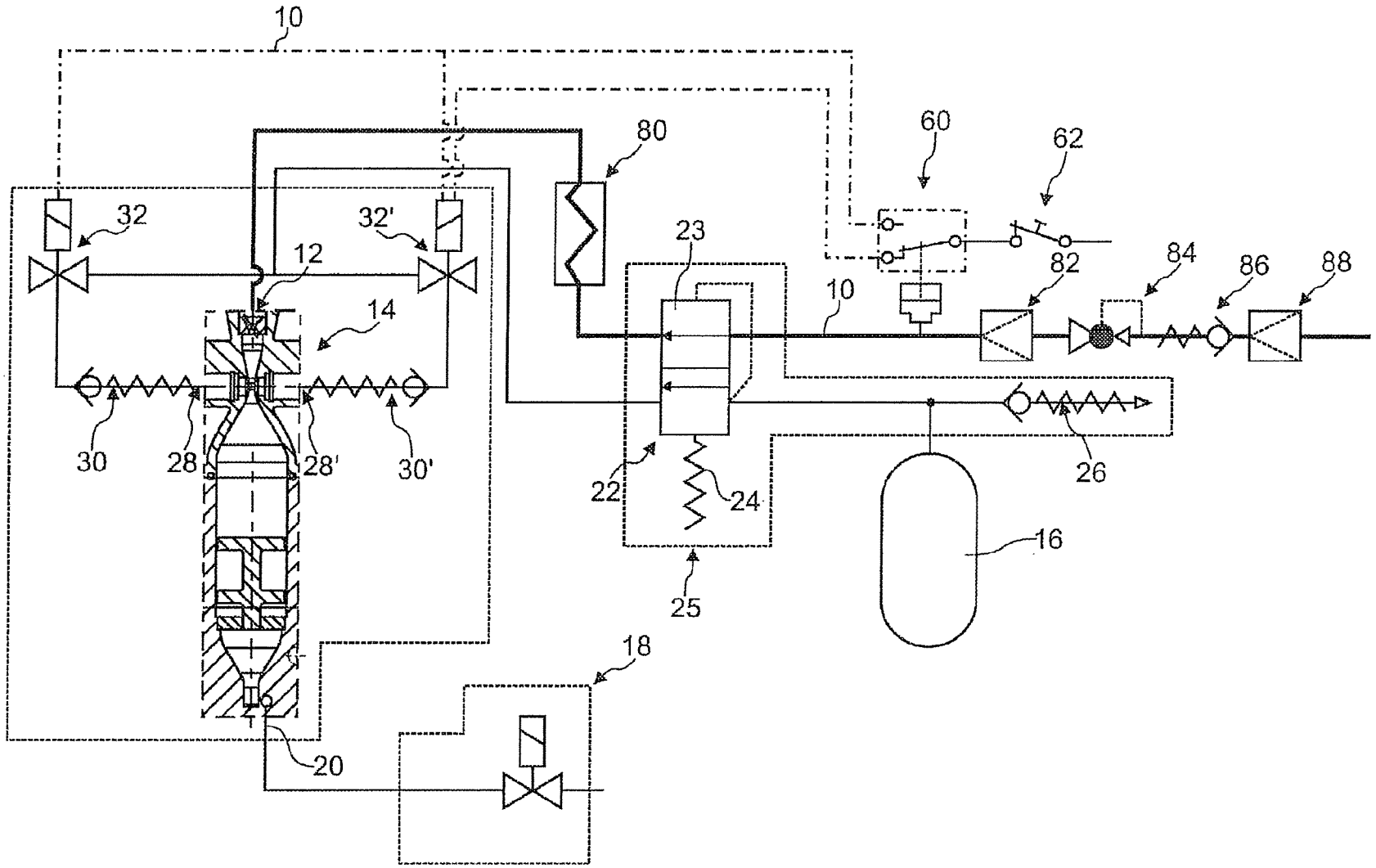
FIG. 1 shows a principle diagram of a first embodiment of a device according to the invention.

For the purpose of illustrating the invention, the figures show a tapping device (for carbonated tap water), comprising a device according to the invention for enriching a liquid stream (here a drinking water stream) with a gas (here carbon dioxide).

A drinking water pipe which is connected to an inlet connection 12 of a flow-through mixer 14 is designated by reference no. 10. In the flow-through mixer 14, a drinking water stream from the drinking water pipe 10 is enriched with carbon dioxide gas. The gas feed for the flow-through mixer 14 comprises a carbon dioxide cylinder 16, in which carbon dioxide is stored under pressure. A tap unit 18 is connected to an outlet connection 20 of the flow-through mixer 14. The user via this tap unit 18 may directly tap drinking water enriched with carbon dioxide from the water pipe.

Reference no. 22 designates a gas pressure control valve through which the carbon dioxide cylinder 16 is connected to the flow-through mixer 14. This valve 22 controls the gas pressure as a function of the water pressure, i.e. it maintains the pressure difference between the gas and the water, which are both fed into the flow-through mixer 14, at a predetermined set value. For this, the water pressure in the drinking water pipe 10 is for example applied to an adjustment member 23 of the gas pressure control valve 22. If the difference between the gas and water pressure exceeds the predetermined set value, the gas pressure control valve 22 then closes. If the difference between the gas and water pressure drops below the predetermined set value, the gas pressure control valve 22 then opens correspondingly. A constant set value for the pressure difference may for example be preset via a spring means. By selecting the preliminary tension of the spring means 24, it is possible to adjust the predetermined set value for the pressure difference; whereby depending on the arrangement of the spring means 24, the gas pressure may be higher or lower than the water pressure. However, it is also possible to use a pressure controller with a fixed pressure difference set value with or without a spring means 24. A suitable valve unit 25 for adjusting the gas pressure as a function of the water pressure is for example marketed by the ROTAREX group under the designation of B0821. Further, an overflow valve 26 on the low pressure side is integrated into this ROTAREX valve unit 25, which protects the user against a too high gas pressure behind the gas pressure control valve 22. A safety device on the high pressure side, such as for example a bursting disk, is most often integrated into a cylinder valve (not shown) of the carbon dioxide cylinder 16.

The flow-through mixer 14 comprises two gas connections 28, 28'. Each of these gas connections is connected via a check valve 30, 30' and a solenoid valve 32, 32' to a low pressure connection of the gas pressure control valve 22. The check valves 30, 30' should here prevent water from entering the gas feed, in the case when the gas pressure in the gas feed falls below the water pressure in the flow-through mixer 14. The solenoid valves 32, 32' which are closed in the absence of current, are part of a valve control of the gas feed, which will be described later on.

Figure 2:
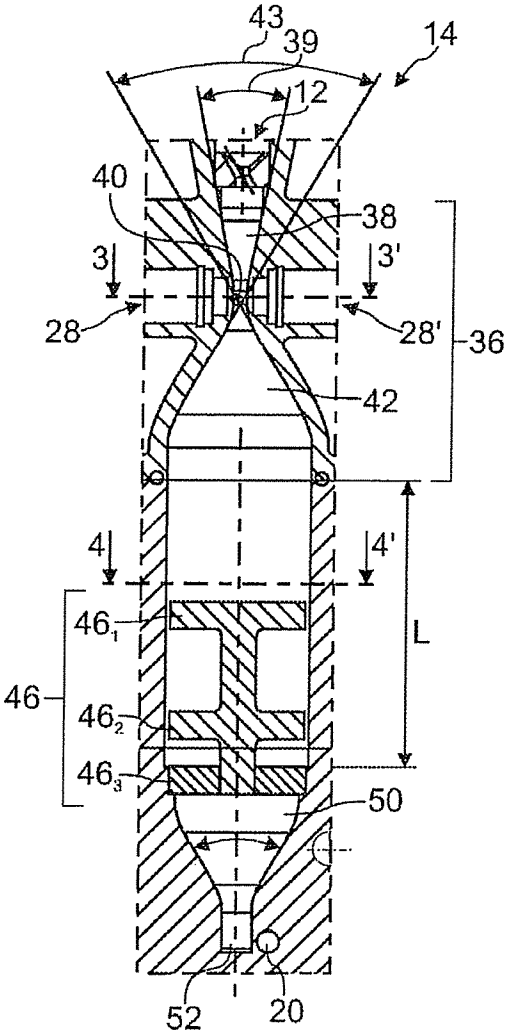
FIG. 2 shows a longitudinal section through a flow-through mixer of a device according to the invention.

FIG. 2 shows an enlarged longitudinal section through the flow-through mixer 14. It comprises on the water admission side, a Venturi nozzle 36 with a convergent inlet section 38, a constriction 40 and a diverging outlet section 42. The converging inlet section 38 has an opening angle which is essentially more acute than the opening angle of the diverging outlet section 42. The constriction 40 is a cylindrical channel, the length of which is approximately slightly greater than its diameter.

The diverging outlet section 42 of the Venturi nozzle 36 opens into a cylindrical expansion chamber or mixing chamber 44, the length L of which corresponds to approximately 1.5 times its diameter. The diameter of the expansion chamber 44 is in this case about 10 times greater than the diameter of the constriction 40. This expansion chamber is delimited axially by a baffle plate insert 48, with several (for example three) baffle plates $\mathbf{46}_1$, $\mathbf{46}_2$, $\mathbf{46}_3$, positioned behind each other, which still further improves the mixing of the carbon dioxide with the tap water. Via the baffle plate insert 46, the carbonated drinking water flows out of the expansion chamber 44 into an outlet cone 50 of the flow-through mixer 14. The tapered end 52 of this outlet cone 50 is connected via a connecting channel (not shown in the section of FIG. 2) with the outlet connection 20 of the flow-through mixer 14, which on its side is connected with the tap unit 18 (see FIG. 1).

Figure 4:
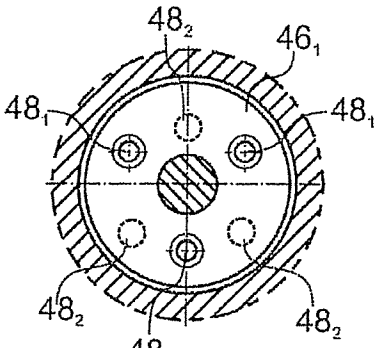
FIG. 4 shows a cross-section along the section line 4-4' through the flow-through mixer of FIG. 2.

In FIG. 4, a top view over the first baffle plate $\mathbf{46}_1$ of the baffle plate insert 46 is shown. Three through-holes $\mathbf{48}_1$ for the drinking water are distinguished. The second baffle plate $\mathbf{46}_2$ also has several through-holes $\mathbf{48}_2$ for the drinking water, which are drawn in FIG. 4 with a dashed line in order to illustrate that these through-holes $\mathbf{48}_2$ are positioned axially offset relatively to the through-holes $\mathbf{48}_1$ of the first baffle plate $\mathbf{46}_1$. Also the third baffle plate $\mathbf{46}_3$ has several through-holes for the drinking water, which are again positioned axially offset relatively to the through-holes $\mathbf{48}_2$ of the second baffle plate $\mathbf{46}_2$. By means of these successive changes in direction and constrictions of the water/gas stream, the mixing of carbon dioxide with tap water is improved significantly.

Figure 3:
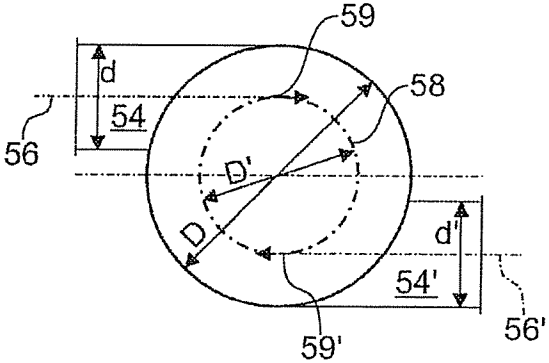
FIG. 3 shows a highly enlarged cross-section along the section line 3-3' through the flow-through mixer of FIG. 2.

FIG. 3 shows a highly enlarged cross-section through the constriction 40 of the Venturi nozzle 36 at the level of the gas feed. Two gas channels 54, 54' are distinguished which, offset and from opposite directions, open into the constriction 40. If D is the diameter of the constriction 40 and d is the diameter of a gas channel 54, 54', then $d<0.5$ D, i.e. the diameter of a gas channel 54, 54' should be smaller than half the diameter of the constriction 40. The extended longitudinal axis 56, 56' of each of the two gas channels 54, 54' is here tangential to an imaginary cylinder surface 58 with a diameter D', which is coaxial with the cylindrical constriction 40, and the diameter of which is such that $D'>d$. In the preferred embodiment $D'=D-d$. The tangency points (i.e. the contact points of the extended longitudinal axis 56, 56' with the imaginary cylinder surface 58) lie at 180° from each other. The arrows 59, 59' in FIG. 3 give the direction with which the gas flows out of the gas channels 54, 54' into the constriction 40. It is considered here that both gas channels 54, 54' introduce the gas in the same direction (here clockwise) into the constriction 40.

Figure 5:
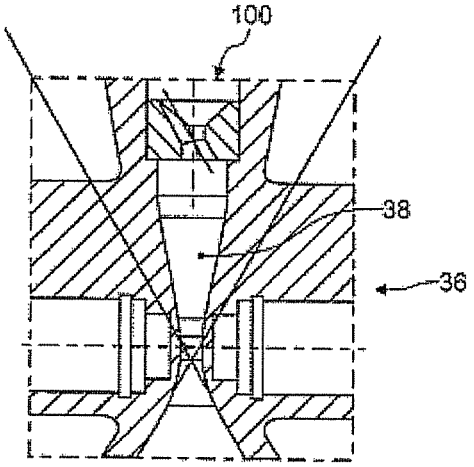
FIG. 5 shows a longitudinal section through the inlet region of a flow-through mixer of a device according to the invention, wherein a deflecting body is positioned in this inlet region.

In FIG. 5, a vortex device 100 is shown, which is positioned directly in front of the converging inlet section 38 of the Venturi nozzle 36. The purpose of this vortex device 100 is to deflect and vortex the water in front of the Venturi nozzle 36, which has a very positive influence on the carbonation result.

Figure 6:
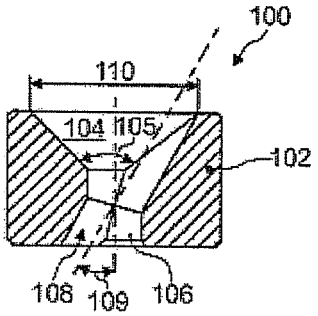
FIG. 6 shows a highly enlarged longitudinal section through the deflecting body of FIG. 5.

FIG. 6 shows a preferred, because extremely simple, embodiment of such a vortex device 100. It comprises a normally cylindrical body 102 with an inlet cone 104 converging in the direction of the flow, with an opening angle 105 of about 90°. In the body 102, the inlet cone 104 opens into an axial bore 106 and an oblique bore 108. An angle 109 of about 30° is advantageously defined between the axial bore 106 and the oblique bore 108. The diameters of the axial bore 106 and of the oblique bore 108 are advantageously about 3 to 5 times smaller than the inlet diameter 110 of the inlet cone 104. In FIG. 6 they have for example approximately the same diameter as the constriction 40 of the Venturi nozzle 36.

With reference to FIG. 1, a first embodiment of the valve control of the gas feed will now be described in more detail. Both solenoid valves 32, 32' closed in the absence of current, are controlled by a pressure switch 60, which applies water pressure in the drinking water pipe 10. If the water pressure in the drinking water pipe 10 is smaller than a predetermined pressure $P_0$, then both solenoid valves 32, 32' are provided with current and are opened. If the water pressure is greater than the pressure $P_0$, only the solenoid valve 32' is provided with current and is opened. In other words, if the water pressure is smaller than $P_0$, the gas flows via both gas channels 54, 54' into the constriction 40 of the Venturi nozzle 36; if however the water pressure is greater than $P_0$, the gas only flows via one of the two gas channels 54, 54' in the constriction 40 of the Venturi nozzle 36. The pressure switch 60 may naturally also be replaced with a pressure sensor, which is connected to an electronic circuit device, which then controls the solenoid valves 32, 32'.

Reference number 62 indicates a switch, which allows the current supply of both solenoid valves 32, 32' to be interrupted. In order to be able to tap carbonated water out of the tap unit 18, the switch 62 must be closed. Otherwise, both solenoid valves 32, 32' are without current, i.e. closed, independently of the switching state of the pressure switch 60, so that no gas is mixed in the water stream. This switch 62 consequently allows both tapping of "still water" and "soda water" out of the tap unit 18.

For completeness, it will still be mentioned that in the device of FIG. 1 on the side of the water connection for example the following components may further be provided: a cooling unit 80; a fine filter 82 (for example an active coal filter with exchangeable cartridges); a water pressure reducer 84; a backflow preventer 86 and a coarse particle filter 88. The cooling unit 80 allows cooling of the water to a temperature of 4 to 8° C. before carbonation, which increases the efficiency of the carbonation. The water pressure reducer 84 is for example to be actuated when the water pipe pressure may exceed 6 bars.

The tap unit 18, only shown schematically, advantageously has a solenoid valve, a conical vortex nozzle and jet regulator. The water flowing out of the solenoid valve or the water/gas mixture is introduced here eccentrically into the conical vortex nozzle, before it leaves the tap unit 18 via the jet regulator. A suitable jet regulator is sold for example by NEOPERL under the trademark name of Perlator®.

APPLICATION EXAMPLE 1

A flow-through mixer 14, which was applied in a tap device for carbonated tap water and ensured here excellent carbonation at a water pressure comprised 2.5 bars and 6.0 bars and a water flow rate of about 120 L/h, had the following dimensions:

Opening angle 39 of the inlet section 38: 22°
Opening angle 43 of the outlet section 42: 60°
Diameter of the constriction 40 D=2.0 mm
Length of the constriction 40: 2.0 mm
Diameter of a gas channel 54, 54': D=0.8 mm
Diameter of the imaginary cylinder surface 58: D'=1.2 mm
Diameter of the expansion chamber 44: 20 mm
Length of the expansion chamber 44: 42 mm.

The test device comprised, as shown in FIG. 1, a gas pressure control valve 22 loaded with the water pressure and two solenoid valves 32, 32' on the gas side, which are controlled via a pressure switch 60. The gas pressure control valve 22 was adjusted so that at the output of the gas pressure regulator 22, the gas pressure corresponded to approximately the water pressure. The pressure switch 60 was adjusted so that up to a water pressure of 3.5 bars, both solenoid valves 32, 32' opened, starting from 3.5 bars, however only one of the two solenoid valves 32, 32' opened, so that starting from 3.5 bars, the gas only flowed in from one side into the constriction 40 of the Venturi nozzle 36. The maximum water pressure was limited by the water pressure reducer 84 to 6 bars.

Figure 7:
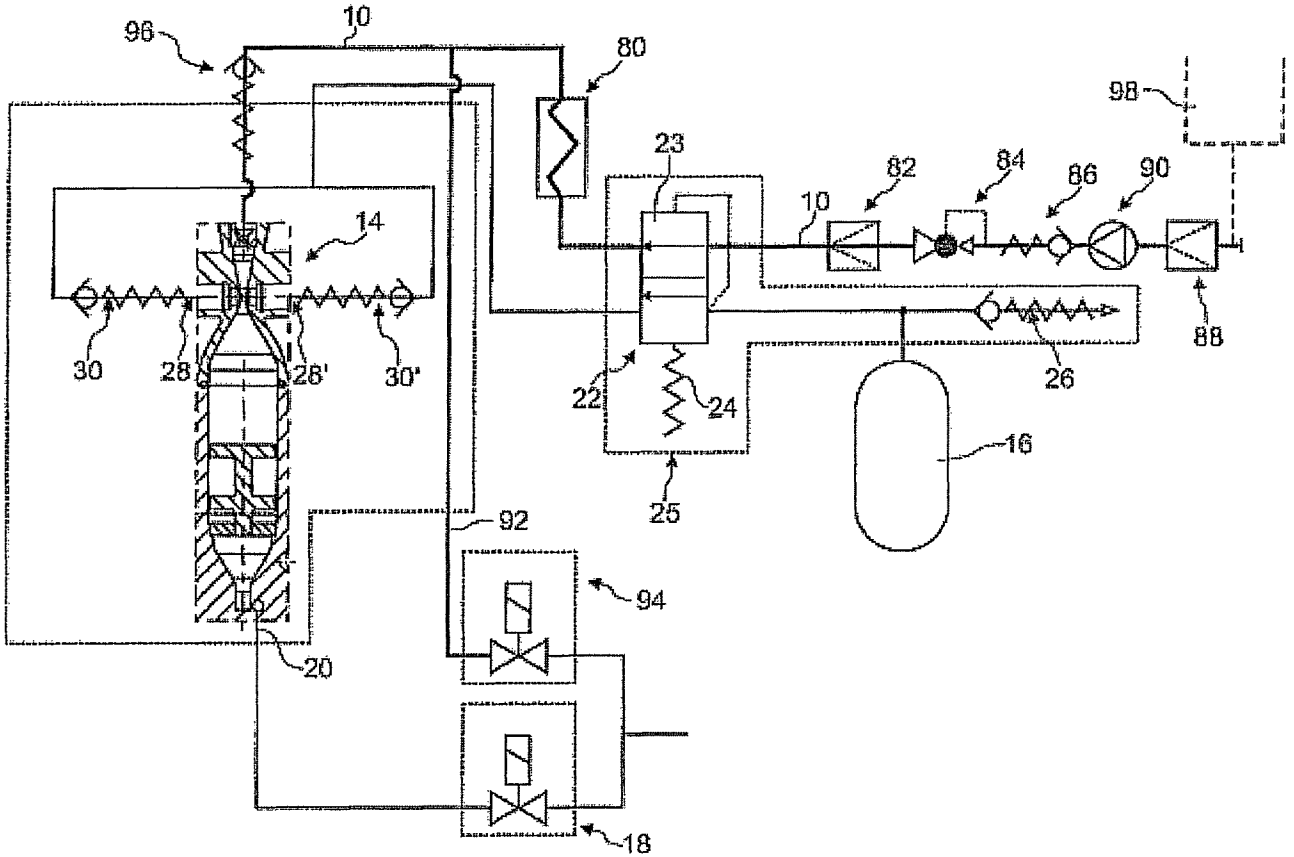
FIG. 7 shows a principle diagram of a further embodiment of a device according to the invention.

The embodiment of FIG. 7 differs from the embodiment according to FIG. 1 mainly in that a pump 90 is provided in the drinking water pipe 10. This pump 90 by cooperating with the water pressure reducer 84, allows adjustment of a relatively constant water pressure from about 4 to 5 bars. The flow-through mixer 14 is thereby laid out for this relatively small pressure range and it is possible to do without both pressure-dependent controlled solenoid valves 32, 32' from FIG. 1. A bypass pipe 92 towards the flow-through mixer 14 with a separate tapping valve 94 allows the tapping of still water after the cooling device 80. A check valve 96 at the inlet connection of the flow mixture 14 prevents the possibility of gas over-flowing into the drinking water pipe 10 and the bypass pipe 92, if the check valve 94 is opened. The embodiment of FIG. 7 also allows operation of the device with a drinking water container 98 as an alternative to a connection to the drinking water mains network.

APPLICATION EXAMPLE 2

The flow-through mixer 14 described earlier was applied in a test device, which corresponded to the circuit diagram of FIG. 7, wherein this test device also comprised a cooling device 80. A pump 90 and a water pressure regulator 84 was laid out and adjusted so that a water pressure of about 4.5 bars prevailed on the inlet connection 12 of the flow-through mixer. The water temperature was adjusted to 6° C. The gas pressure control valve 25 was adjusted so that about 6.8-7.0 g of carbon dioxide were injected per liter of water. The maximum tap output was 2 liters per minute.

Excellent carbonation results were obtained both in the case of a horizontal and of a vertical installation of the flow-through mixer 14.

The invention claimed is:

1. A device for enriching a liquid stream with a gas, said device comprising:

a flow-through mixer with a Venturi nozzle that has a rotationally symmetric constriction with a diameter D and through which the liquid stream can flow axially, the Venturi nozzle further including an inlet section converging in a direction of flow of the liquid stream and an outlet section diverging in said direction of flow, said inlet section and said outlet section each having an opening angle, said opening angle of the inlet section being substantially more acute than said opening angle of said outlet section, wherein said outlet section opens into a cylindrical expansion chamber, said cylindrical expansion chamber having a diameter about 8 to 12 times larger than said diameter D of said constriction; and a gas feed for laterally feeding in the gas into said constriction of said Venturi nozzle;

wherein said gas feed comprises at least one gas channel that has a diameter d<0.5 D and a longitudinal axis, said gas feed laterally opening into said constriction of said Venturi nozzle so that its longitudinal axis is tangential to an imaginary cylinder surface that is coaxial with said constriction and has a diameter D'>d.

2. The device according to claim 1, wherein D'=D−d.

3. The device according to claim 1, wherein 0.25 D<d<0.5 D.

4. The device according to claim 1, wherein said constriction of said Venturi nozzle is formed by a cylindrical channel with a diameter D and with a length that corresponds approximately to its diameter D.

5. The device according to claim 1, wherein said opening angle of said inlet section is about 2.5 to 3 times smaller than said opening angle of said outlet section.

6. The device according to claim 1, further comprising a vortex device, wherein said Venturi nozzle has an inlet section converging in a direction of flow of the liquid stream and said vortex device is directly positioned in front of said converging inlet section of said Venturi nozzle.

7. The device according to claim 6, wherein said vortex device comprises a body with an inlet cone converging in said direction of flow, with an axial bore and with an oblique bore, said cone opening into said axial bore and into said oblique bore.

8. The device according to claim 1, further comprising a cylindrical expansion chamber and a baffle plate insert with through-holes, wherein said Venturi nozzle opens into said cylindrical expansion chamber and said cylindrical expansion chamber is axially delimited by said baffle plate insert.

9. The device according to claim 1, wherein said gas feed comprises a plurality of gas channels, each of said plurality of gas channels having a diameter d<0.5 D and a longitudinal axis, wherein each of said plurality of gas channels opens into said constriction of said Venturi nozzle laterally so that its longitudinal axis is tangential to an imaginary cylinder surface that is coaxial with said constriction and has a diameter D'>d.

10. The device according to 9, wherein all of said plurality of gas channels introduce gas in the same direction into the constriction.

11. The device according to claim 10, wherein said longitudinal axes of said plurality of gas channels have contact points with the imaginary cylinder surface, said contact points being angularly separated by an angle of 360°/said plurality of gas channels.

12. The device according to claim 1, wherein said gas feed comprises a gas pressure control valve for controlling gas pressure as a function of pressure in the liquid stream.

13. The device according to claim 1, wherein two gas channels open into said constriction and said gas feed comprises a valve control, said valve control being configured to apply gas to either one or two gas channels, depending on pressure in the liquid stream.

14. A device for enriching a liquid stream with a gas, said device comprising:

a flow-through mixer with a Venturi nozzle that has a rotationally symmetric constriction with a diameter D and an axis of symmetry, the Venturi nozzle further including an inlet section converging in a direction of flow of the liquid stream and an outlet section diverging in said direction of flow, said inlet section and said outlet section each having an opening angle, said opening angle of the inlet section being substantially more acute than said opening angle of said outlet section, wherein said outlet section opens into a cylindrical expansion chamber, said cylindrical expansion chamber having a diameter about 8 to 12 times larger than said diameter D of said constriction; and a gas feed for laterally feeding in the gas into said constriction of said Venturi nozzle;

wherein said gas feed comprises at least one gas channel that has a diameter $d<0.5$ D and a longitudinal axis, said gas feed laterally opening into said constriction of said Venturi nozzle and so that its longitudinal axis is perpendicular to said axis of symmetry of said constriction.

15. The device according to claim 14, wherein said gas feed comprises a plurality of gas channels, each gas channel having a diameter $d<(1/\text{plurality of gas channels})D$ and a longitudinal axis, wherein each of said plurality of gas channels opens into said constriction of said Venturi nozzle laterally and so that its longitudinal axis is perpendicular to said axis of symmetry of said constriction.

16. The device according to claim 15, wherein said plurality of gas channels includes more than 2 gas channels, and said longitudinal axes of said plurality of gas channels lying in a same plane and defining a regular polygon in said plane.

17. The device according to claim 14, wherein said constriction of said Venturi nozzle is a cylindrical channel with a diameter D and with a length that corresponds approximately to its diameter D.

* * * * *